United States Patent [19]

Harmke et al.

[11] 4,089,422

[45] May 16, 1978

[54] AIR CLASSIFIER

[75] Inventors: Charles Raymond Harmke, Seattle; Daniel Edward O'Neill, Edmonds, both of Wash.

[73] Assignee: The Boeing Company, Seattle, Wash.

[21] Appl. No.: 621,926

[22] Filed: Oct. 14, 1975

[51] Int. Cl.[2] ..... B07B 4/02

[52] U.S. Cl. ..... 209/137; 209/474

[58] Field of Search ..... 209/20, 135, 11, 474, 209/477, 466, 468, 134, 115, 133, 143, 136–139; 302/29, 31

[56] References Cited

U.S. PATENT DOCUMENTS

| | | | |
|---|---|---|---|
| 29,198 | 7/1860 | Seymour | 209/20 X |
| 2,358,293 | 9/1944 | Kendall | 209/466 |
| 2,403,740 | 7/1946 | Muend | 209/133 X |
| 2,978,103 | 4/1961 | Cowher | 209/135 |
| 3,065,853 | 11/1962 | Binnix | 209/468 |
| 3,446,355 | 5/1969 | Boucraut | 209/474 |
| 3,799,339 | 3/1974 | Breitholtz | 209/135 X |
| 3,804,250 | 4/1974 | Dankesreiter | 209/11 X |
| 3,836,085 | 9/1974 | Brown | 209/477 X |
| 3,920,542 | 11/1975 | Laird | 209/474 X |

FOREIGN PATENT DOCUMENTS

| | | | |
|---|---|---|---|
| 798,731 | 3/1936 | France | 209/468 |
| 592,115 | 1/1930 | Germany | 209/474 |
| 1,150,320 | 6/1963 | Germany | 302/29 |
| 243,531 | 12/1967 | U.S.S.R. | 209/134 |

*Primary Examiner*—Robert Halper
*Attorney, Agent, or Firm*—Kenneth W. Thomas

[57] ABSTRACT

An air classifier for separating a heterogeneous mixture of particles into heavier and lighter fractions includes an air passageway through which a horizontal primary air stream is flowing, a pair of air deck sections extending along the bottom of the passageway through which deck air is flowing upwardly within and downstream of the passageway, air nozzles located between the air deck sections through which a primary vertical air stream is flowing, the latter also preferably flowing with a horizontal component moving downstream of the passageway, a heavy particle deflector and remover downstream of the second air deck section, and a light particle trapping and removal arrangement downstream of the heavy particle deflector. The particle mixture is introduced into the passageway over the first air deck section just upstream of the primary vertical air nozzle, whereupon the particles are immediately stratified in horizontal layers of heavy and light fractions by the upward air currents and transported to the end of the passageway by the horizontal air currents, where the fractions are separated from the air flows and removed from the passageway.

5 Claims, 6 Drawing Figures

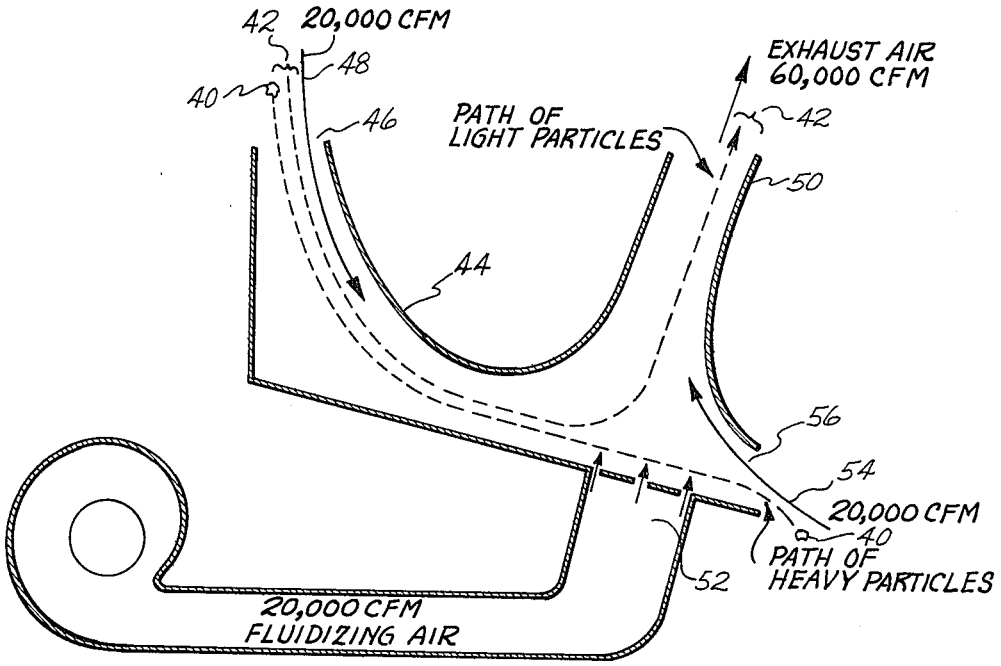
Fig. 2 PRIOR ART
Fig. 3 PRIOR ART
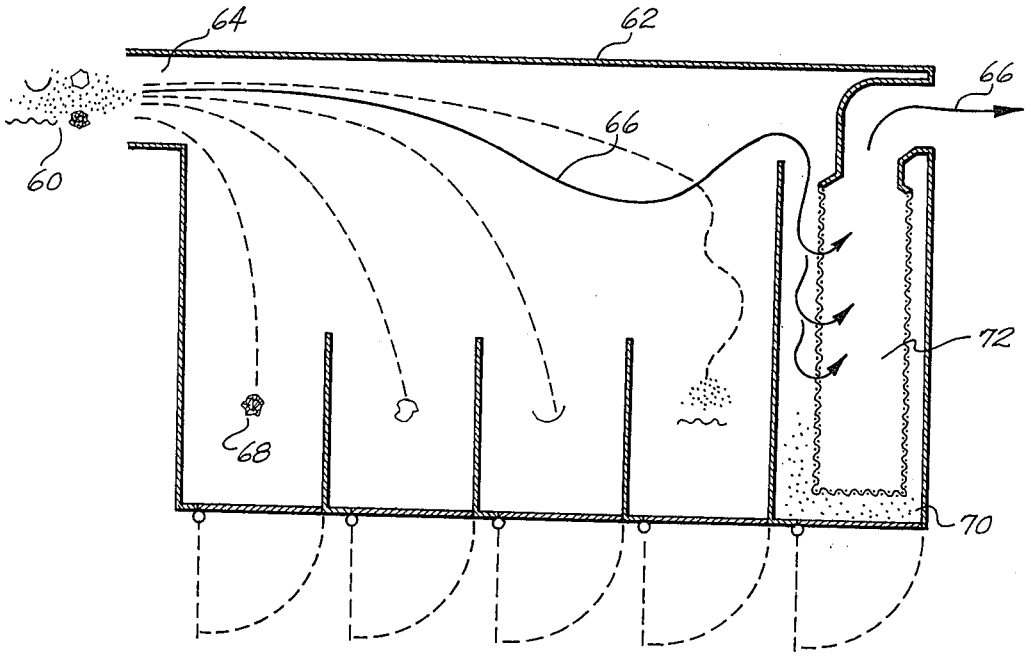

AIR CLASSIFIER

BACKGROUND OF THE INVENTION

1. Field of the Invention

This invention relates to gravitational and air classification of a mixture of particles in a trash reclamation system.

2. Description of the Prior Art

The field of air classification or separation is not new, but has remained somewhat static until the logistics and economics of the contemporary society prompted renewed interest in research to invent better and less costly ways of disposing of the vast quantities of trash produced each day, while, at the same time, allowing the recovery of valuable constituents contained in the trash. Two of the prior art techniques can be seen by reference to FIG. 1. In the first, a mixture 10 of heavy 12, light 14 and fine 16 particles (such as shredded trash) is deposited into an input hopper 18 which ends in an air blocking device 20. The air blocking device 20 delivers the mixture 10 to input conduit 22 while, at the same time, prohibiting the flow of air 24 out through input hopper 18. Air 24 is induced (as by vacuum) into vertical conduit 26 from the bottom to the top as shown in FIG. 1. As the mixture 10 is deposited into vertical conduit 26, gravity 28 tends to pull the particles 12, 14 and 16 down while the air 24 tries to blow them up. The light 14 and fine 16 particles are blown upward by air 24 while the heavy particles 12 fall out the bottom.

Air classification in the second form takes place in the cyclone 30 of FIG. 1. Air 24, light 14 and fine 16 particles enter cyclone 30 tangentially. While air 24 rising in the narrower vertical conduit 26 could support the weight of particles 14 and 16, in cyclone 30 air 24 moves tangentially about the inner periphery of cyclone 30, changes direction, and exits through exit duct 32. Because of the centrifugal force and the larger area in cyclone 30, the light particles 14 can no longer be supported by air 24 and drop out the bottom. Fine particles 16 continue with air 24.

Another prior art air classification system combining elements of the vertical column and cyclone is shown in FIG. 2. Heavy particles 40 and light particles 42 drop into air classifier 44 at inlet 46 along with parallel air 48 and proceed to the bottom of classifier 44 where the main air flow path doubles back toward light outlet 50. Centrifugal force and gravity act on particles 40 and 42 to resist their rising toward light outlet 50. Additionally, fluidizing air 52 and counter flow air 54 are injected to assist the rising air force of parallel air 48. As a result, light particles 42 rise and exit through light outlet 50, while the heavy particles 40 pass out through outlet 56.

A simple form of pure horizontal flow air classifier is shown in FIG. 3. Material 60 enters the classifier 62 at inlet 64 along with parallel air 66. Since the horizontal force of air 66 is constant, the horizontal acceleration of the particles of material 60 is inversely proportioned to mass (Force = mass × acceleration). When the material 60 enters the classifier 62 it is accelerated down by gravity while continuing forward as a function of its horizontal acceleration and velocity. Heavy particles 68 fall into the bin closest to inlet 64 while lighter particles move further along. Fines 70 are carried by air 66 and must be removed by a filter 72.

All these prior art devices work in their fashion to a degree, depending on the application. Cyclones such as that of FIG. 1, for example, have been used successfully for years in the lumber business to carry off undesired sawdust and wood chips. A light dry homogeneous material lends itself ideally to air classification. Unfortunately, domestic and industrial waste does not fall into that category. Trash is a variable both in material content and moisture content and to be successful, a classifier must be able to handle any and all material to accepted standards. One major problem is moisture. Wet lights stuck together tend to respond as a heavy. Thus, in apparatus such as that of FIG. 2 vibrating means are often attached to the device to attempt breakup of clumps entering the classifier and removal of material tending to stick at the bottom of the drop area. Another helpful technique is the pulverizing of the material into smaller particles prior to classification. Pulverizing, however, takes energy. The smaller the end particles, the more energy required. Likewise, raising particles vertically against gravity takes more energy than moving the same particles horizontally. The more the cost of recovery of useful material from trash, the less the incentive to do so. Along the same line, the more complex the apparatus, the higher the initial investment and more likely the need for repair with attendant cost and down time.

In their U.S. Pat. No. 3,799,339 (copy enclosed herewith) Breitholtz and Lindberg disclose a simple apparatus using horizontal air flow to remove rocks from light particulate matter. Unfortunately, its use in trash classifiation, as is the prime objective of the present invention, is limited to a final purification of the previously classified light material as shown in the sales material of the patent's assignee (copy enclosed herewith) and as will become apparent in the description of the present invention to follow hereinafter.

Thus, it is the prime objective of the present invention to provide a horizontal flow air classifier for use with heterogeneous waste materials.

It is a further object of the present invention to provide an air classifier for heterogeneous waste which is simple in design with virtually no critical wearing parts.

It is yet another object of the present invention to provide an air classifier for heterogeneous waste requiring minimal energy in the preparation of said waste prior to classification and minimal energy in the classification of said waste.

DESCRIPTION OF THE DRAWINGS

FIG. 2 is a cutaway side elevation of a prior art air classifier employing a vertical air column and centrifugal force in a vertical plane.

FIG. 3 is a cutaway side elevation of a prior art horizontal air flow air classifier.

DESCRIPTION OF THE PREFERRED EMBODIMENT

Figure 1:
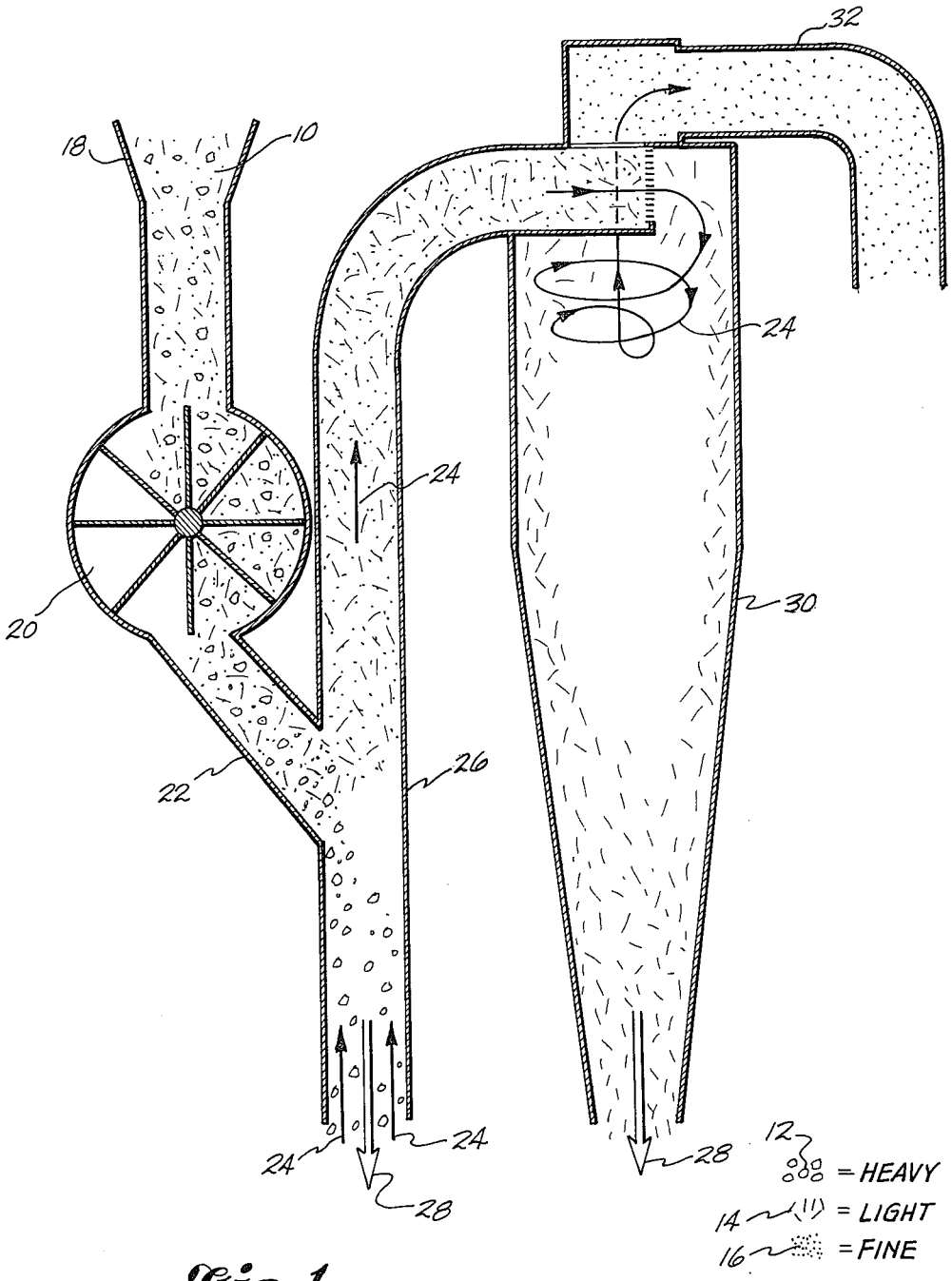
Fig. 1 PRIOR ART
FIG. 1 is a cutaway side elevation of a vertical air column air classifier combined with a cyclone representing prior art.
Figure 4:
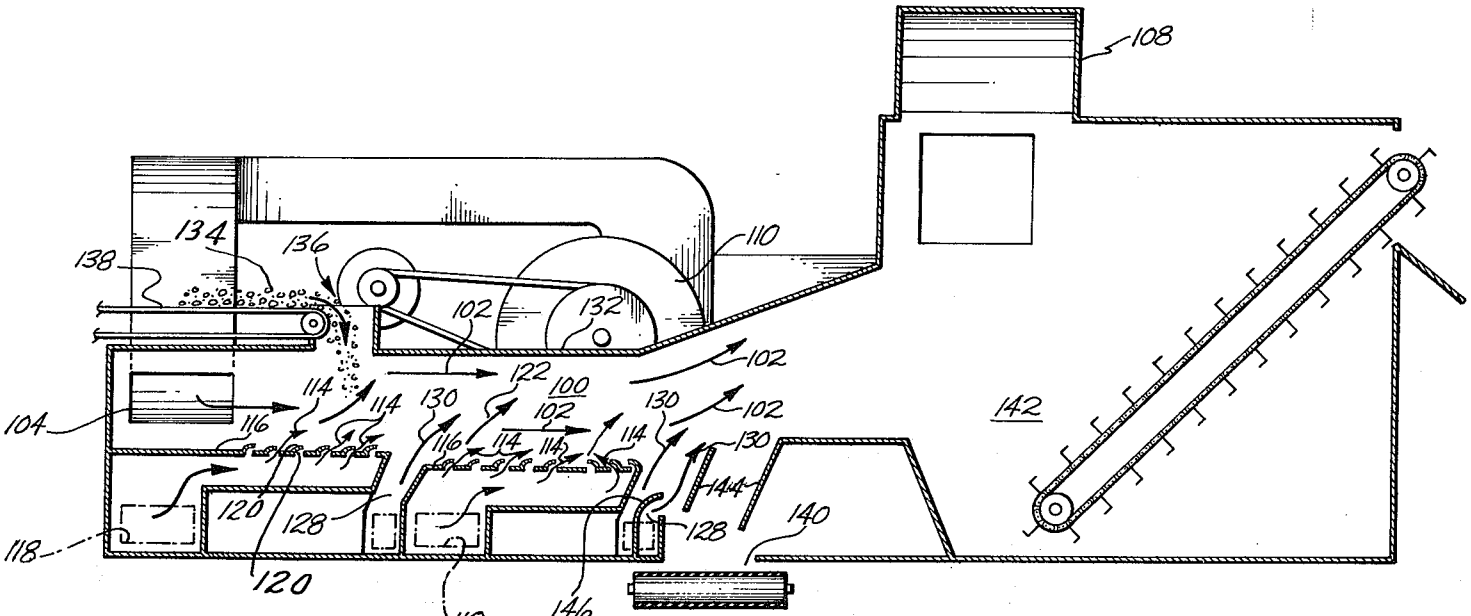
FIG. 4 is a cutaway side elevation of the present invention.
Figure 5:
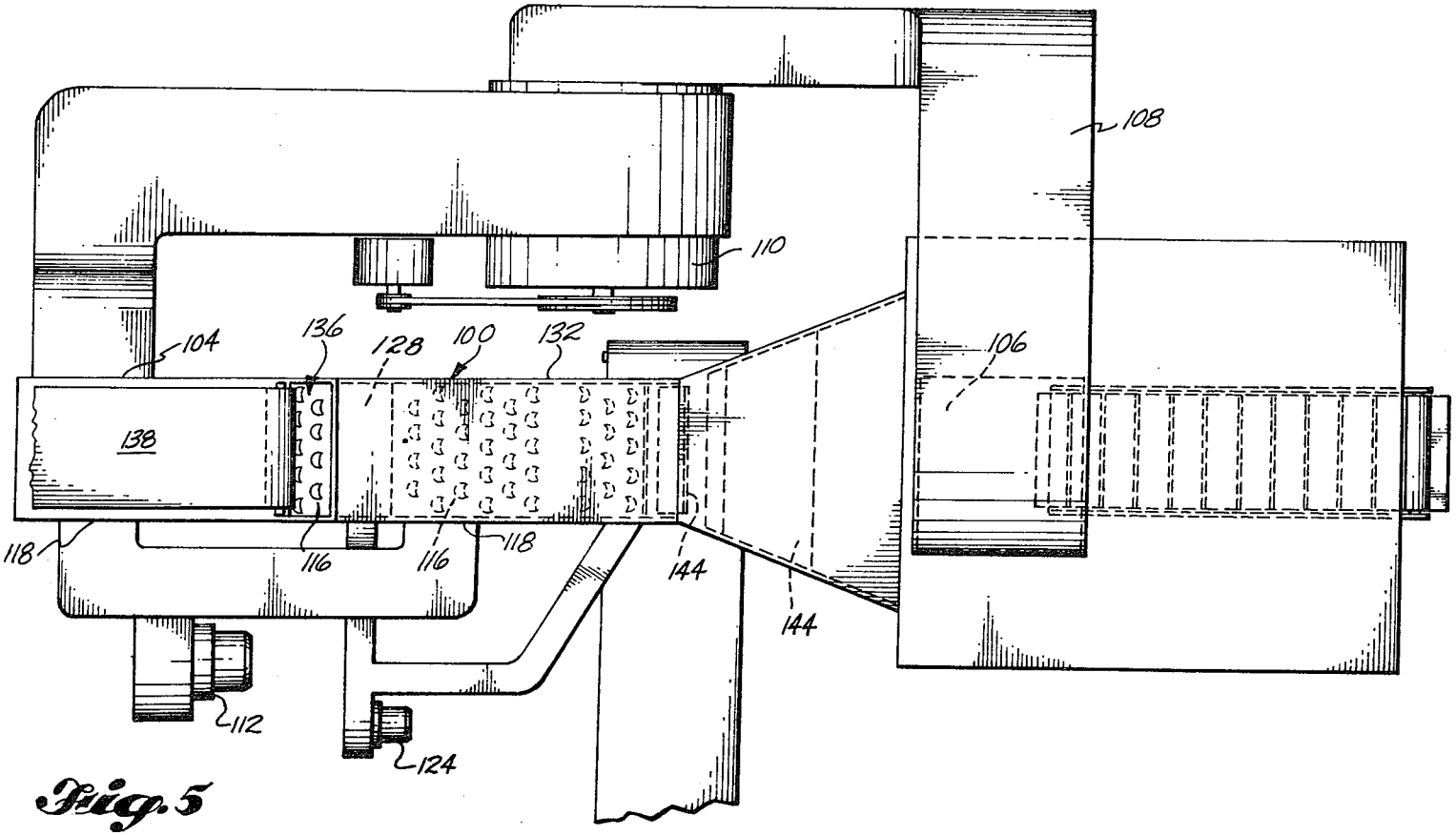
FIG. 5 is a plan view of the present invention.

The preferred embodiment of the present invention is best understood by referring to FIG. 4 and FIG. 5. Where, in the prior art, a single homogeneous stream of trash laden air is formed up to the time of separation, the present invention forms a stratified stream of trash laden air with the heavys on the bottom and the lights on the top. The separation process then involves stripping away the bottom layer of the stratified air stream to a thickness resulting in the removal of heavys of the desired size and weight. This is accomplished by the disclosed apparatus in the following manner.

Figure 6:
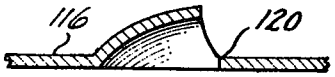
FIG. 6 is a cutaway through a portion of the live deck of the present invention.

The heart of the present air classifier is the substantially horizontal passageway 100. Primary air 102 enters passageway 100 through primary air inlet 104, passes through passageway 100 and exits through primary air outlet 106 downstream of inlet 104. Primary air 102 then is pumped through primary art duct 108 back to primary air inlet 104 by primary air blower 110. This recirculating cycle of primary air 102 creates a strong generally horizontal uniform air flow in passageway 100 moving from primary air inlet 104 to primary air outlet 106. The uniform flow of primary air 102 is altered by two factors. First, deck blower 112 forces deck air 114 into live decks 116, which form the bottom surface of passageway 100, through deck air inlets 118. Deck air 114 exits decks 116 through porous upper surface 120. In actual practice, upper surface 120 has been found to operate well when constructed of sheet steel punched with a plurality of louvers to form a series of air jets as in FIG. 6. Emerging deck air 114 creates secondary vertical air vectors 122 in primary air stream 102 and also serves to create an air bearing surface on the bottom of passageway 100 to resist the sticking of processed materials as is a common problem with prior art classification systems when operating on commercial heterogeneous trash.

Second, nozzle blower 124 forces nozzle air out nozzles 128 located downstream of air inlet 104 to create primary vertical air vectors 130 in primary air stream 102. The result of primary vertical air vectors 130 and secondary vertical air vectors 122 acting on primary air 102 is a stratified air stream which will tend to lift particles in passageway 100 as they are moved from adjacent the end of inlet 104 towards the end of outlet 106. The lighter the particle, the closer it will stay to the top 132 of passageway 100. Air vectors 122 and 130 include vertical and horizontal components flowing respectively upwardly towards the top and downstream of the passageway 100.

To operate for the classification of trash, a stratified air flow is created in passageway 100 as hereinbefore described. Trash 134 is introduced into passageway 100 adjacent to and downstream of air inlet 104 through trash inlet 136 as with a conveyor 138 as shown. Passageway 100 is just upstream of nozzles 128. As trash 134 enters passageway 100 it is subjected to the forces of primary air 102 and vertical air vectors 122 and 130. All the trash 134 is moved toward the end adjacent primary air outlet 106. At the same time, the particles of trash 134 seek an equilibrium position by weight and aerodynamic properties within the stratified air stream. The lights, comprising primarily combustible materials, move toward the top 132 while the heavys, comprising primarily non-combustible metals and glass, stay adjacent the live deck 116. The heaviest particles actually slide along on a cushion of deck air 114. Once the trash 134 has been allowed to reach a stratified state as just described, the layer containing the heavys is stripped to an appropriate thickness to remove the desired particles which leave passageway 100 through heavy exit 140 while the remaining lighter particles continue into plenum 142 containing primary air outlet 106. Because of the volume of plenum 142 the lighter particles remain therein while primary air 102 exits through primary air outlet 106. The actual stripping of the heavy particle laden portion of primary air stream 102 in its stratified state is accomplished by stripping plates 144 which in the preferred embodiment are vertically and rotatably adjustable about a horizontal axis in order to change the amount of primary flow stripped off as heavys. The movement of trash 134 in the stratified primary air stream 102 is substantially horizontal. Stripping plates 144 are positioned as shown to extend above the level of live deck 116. Trash 134 moving adjacent live deck 116 at or below the top of a stripping plate 144 will strike the stripping plate 144 thus stopping its forward momentum. Gravity then causes the trash 134 thus stripped from the moving air stream 102 to fall through heavy exit 140.

It is to be understood that the essence of the present invention is in the formation of an enclosed stratified horizontal air stream moving over a live air deck, introducing trash into the stratified air stream, allowing the trash to seek its equilibrium position within the stratified air stream by weight, and stripping off the heavy portion of the stratified air stream adjacent the live deck to a thickness which will remove the portion of the moving trash stream desired. While many variations of the basic apparatus as disclosed by FIGS. 4 and 5 will accomplish this end, in keeping with the objects of simplicity and lack of critical parts, the embodiment of FIG. 4 and FIG. 5 serves these ends best. For example, the use of a louvered steel plate (or similar) material for the porous top surface of live decks 116 offers the advantage of being strong in resistance to deformation from falling and bouncing heavys yet is economical and easily replaced should the need arise. At the same time, the surface it forms creates the effect of a plurality of slightly angled nozzles which is ideal for the application.

The placement and configuration of the nozzles 128 creating the primary vertical air vectors 130 has proved to operate exceptionally well as shown. The first nozzle 128 placed just downstream from the point of entry of trash 134 through trash inlet 136 creates the primary stratifying effect in primary air stream 102 and quickly forces the trash to its equilibrium level. The distance to the stripping plates 144 can thus be kept quite short (in the order of 10 to 12 feet). The second nozzle 128 placed in conjunction with the first stripping plate 144 then acts at the time of stripping to eliminate any light particles which may have adhered to the heavys being stripped. The addition of the deflector 146 in this second nozzle as shown acts to widen the emerging air vector 130 across the entire opening while allowing a place for heavys to drop out. In actual practice, an air classifier constructed according to the above described embodiment was found to separate the heavy and light particles in processed commercial trash to a degree far in excess of previously tested equipment. This is, of course, of critical importance since the value of any classification system is in its ability to isolate saleable constituents of the processed trash. Too many non-combustibles in the lights removed makes it undesirable for burning as fuel. Likewise, processing of the heavys for the metals therein is more complicated if wet rags and paper are present.

The term "downstream" and "upstream" in the present specification and claims is to be understood as referring to a position or direction with respect to the direction of motion of primary air flow 102, in the usual fluid dynamics sense.

Having thus described our invention, we claim:

1. Apparatus for separating a heterogeneous mixture of heavy and light particles into heavier and lighter fractions comprising:

a generally horizontal passageway;

means for introducing and guiding a pressurized primary air flow into one end area of the passageway and discharging said primary air flow from the other end area of the passageway to thereby induce a horizontal primary air flow longitudinally through the passageway at a predetermined velocity;

an air deck including at least first and second air deck portions, said first portion being upstream of said second portion, each air deck portion having an upper surface extending along a portion of the bottom area of the passageway and deck air conduits arranged to introduce and guide deck air flow through the deck upper surface into the passageway with both horizontal and vertical components of motion, the horizontal component being directed downstream of said passageway;

means for supplying deck air under pressure through said deck air conduits;

means for introducing a mixture of heavy and light particles into an upper area of said passageway adjacent to and downstream of the horizontal primary air flow introduction area and above said first portion of said air deck;

air nozzle means disposed in the bottom area of the passageway adjacent to but downstream of the area of introduction of said mixture of heavy and light particles and upstream of said second air deck portion, said air nozzle means arranged to introduce and guide primary vertical air flow into the passageway independently of said air deck flow across substantially the entire width of the passageway, the primary vertical air flow including a vertical component of motion and constituting a primary vertical air vector, the vertical component of air flow through the air deck constituting a secondary vertical air vector;

means for supplying air flow under pressure to said air nozzle means;

heavy fraction particle deflector means disposed downstream of said second air deck portion and having an upper area extending a predetermined distance above a horizontal plane that includes air deck upper surface;

means for collecting and removing from the passageway deflected heavy fraction particles;

means located entirely downstream of said heavy fraction particle deflector means for discharging air flows from the passageway that have been introduced through the nozzle and the air deck;

means located entirely downstream of said heavy fraction particle deflector means for collecting and removing from the passageway light fraction particles;

whereby heavy and light particles introduced into the passageway are caused to become and remain vertically stratified while moving horizontally through the passageway under the influence of air flows within the passageway, and are caused to become separated into heavier and lighter fractions prior to their sequential downstream collection and removal from the passageway.

2. The apparatus recited in claim 1, including a second air nozzle means disposed in the bottom of the passageway adjacent to and upstream of said heavy fraction particle deflector means, said second air nozzle means arranged to introduce and guide additional primary vertical air flow into the passageway across substantially the entire width of the passageway and independently of said deck air flow; and means supplying air flow under pressure to said second air nozzle means.

3. The apparatus recited in claim 2, wherein said heavy fraction particle deflector includes an upstream surface, and including means for directing at least a portion of the air flow from said second air nozzle upwardly across the upstream surface of said heavy fraction particle deflector means.

4. A process of separating a heterogeneous mixture of heavy and light particles into heavier and lighter fractions comprising a. establishing a horizontal flow of primary air longitudinally through the horizontal passageway from an upstream to a downstream end at a suitable velocity to transport at least lighter fraction particles longitudinally through the passageway;

b. establishing a flow of deck air through the upper surface of a divided air deck extending along the bottom of the passageway, the air deck flow moving upwardly at an angle so that it has both a horizontal and a vertical component of motion, with the horizontal component moving in the same direction as the flow of primary air, a first portion of the air deck lying upstream of a second portion, and both portions extending downstream from that area of the passageway where primary air flow is first established;

c. feeding a heterogeneous mixture of heavy and light particles downwardly into the passageway at an area thereof above the first portion of the air deck;

d. injecting into the passageway from the bottom thereof just downstream of the area of the passageway where the heavy and light particles are fed thereinto and between the first and second portions of the air deck a flow of air that is independent of deck air flow and including a vertical component of motion flowing generally towards the top of the passageway, the velocity of the last said air flow being sufficient to cause stratification of light and heavy particles;

e. collecting heavy fraction particles that have settled to the bottom of the passageway and are moving downstream therealong under the influence of the horizontal primary and deck air flows by allowing such heavy fraction particles to drop through a collection opening in the bottom of the passageway downstream of the second portion of the air deck;

f. collecting light fraction particles by separating them from the air flows moving through the passageway entirely downstream of the heavy fraction collection area of the passageway.

5. The process recited in claim 4 including the step of injecting an additional flow of air generally vertically upwardly through at least a portion of the heavy fraction collection opening in the passageway and independently of said deck air flow.

* * * * *